US010286434B2

(12) United States Patent
Haverkamp

(10) Patent No.: US 10,286,434 B2
(45) Date of Patent: May 14, 2019

(54) ROLLING MILL, AND DEVICE AND METHOD FOR DETERMINING THE ROLLING OR GUIDING GAP OF THE ROLL STANDS OR GUIDE STANDS IN A MULTI-STAND ROLLING MILL

(75) Inventor: Mark Haverkamp, Duesseldorf (DE)

(73) Assignee: SMS group GmbH, Duesseldorf (DE)

( * ) Notice: Subject to any disclaimer, the term of this patent is extended or adjusted under 35 U.S.C. 154(b) by 28 days.

(21) Appl. No.: 14/343,557

(22) PCT Filed: Sep. 14, 2012

(86) PCT No.: PCT/DE2012/000909
§ 371 (c)(1),
(2), (4) Date: Mar. 7, 2014

(87) PCT Pub. No.: WO2013/037350
PCT Pub. Date: Mar. 21, 2013

(65) Prior Publication Data

US 2014/0216121 A1 Aug. 7, 2014

(30) Foreign Application Priority Data

Sep. 14, 2011 (DE) ..... 10 2011 113 135

(51) Int. Cl.
*B21B 38/10* (2006.01)
*B21B 31/16* (2006.01)
*B21B 37/58* (2006.01)

(52) U.S. Cl.
CPC ..... *B21B 38/10* (2013.01); *B21B 31/16* (2013.01); *B21B 37/58* (2013.01); *B21B 2273/22* (2013.01)

(58) Field of Classification Search
CPC ..... B21B 2273/22; B21B 38/00; B21B 31/16; B21B 17/04; B21B 38/10; B21B 13/103;
(Continued)

(56) References Cited

U.S. PATENT DOCUMENTS 7,320,237 B2 * 1/2008 Kubota ..... B21B 31/16 356/153
7,397,501 B2 * 7/2008 Afsenius ..... G06T 5/50 348/208.13

(Continued)

FOREIGN PATENT DOCUMENTS

CN 101934291 A 1/2011
DE 37 24 982 A1 2/1989

(Continued)

OTHER PUBLICATIONS

Please Find attached machine translation of claims and detailed description from JP2011140050A from J-PLAT PAT.*

(Continued)

*Primary Examiner* — Peter Dungba Vo
*Assistant Examiner* — Joshua D Anderson
(74) *Attorney, Agent, or Firm* — Collard & Roe, P.C.

(57) ABSTRACT

A method for determining the rolling or guiding gap of the roll stands or guide stands in a multi-stand rolling mill positions a comparison scale at at least one stand, preferably at the first and the last stand, and subsequently the rolling or guiding gap of the respective stand is determined. In this method, a camera is arranged at one of the input or output sides and a transmitter for a reference device, a reference transducer and/or a reference scale is arranged at the other of the input or output sides before the comparison scale is positioned, such that adjustment operations at the camera can subsequently be avoided.

24 Claims, 3 Drawing Sheets

Figure 1:
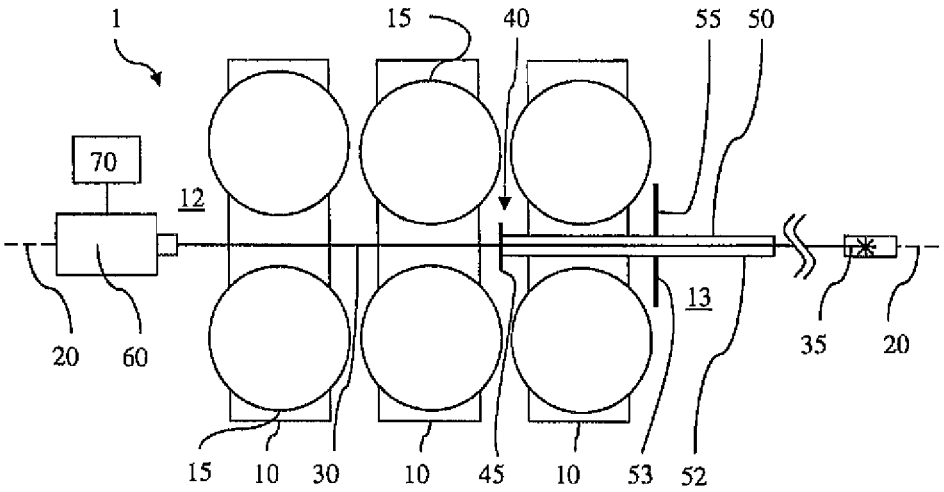

(58) Field of Classification Search
CPC ..... B21B 13/147; B21B 1/18; B21B 31/20; B21B 37/58; B21B 38/105; B21C 51/00; G01B 11/00; G01B 11/043; G01B 11/046; G01B 11/27; G06T 7/10; G06T 7/507; G06T 7/586
USPC ..... 356/32, 34, 600, 601, 609
See application file for complete search history.

(56) References Cited

U.S. PATENT DOCUMENTS

| | | | | |
|---|---|---|---|---|
| 2005/0064469 | A1* | 3/2005 | Schulz | G01N 33/54366 435/6.11 |
| 2010/0097487 | A1* | 4/2010 | Marom | G02B 27/0075 348/222.1 |

FOREIGN PATENT DOCUMENTS

| | | | |
|---|---|---|---|
| DE | 37 29 176 | A1 | 3/1989 |
| DE | 10 2006 057040 | B3 | 5/2008 |
| EP | 1 679 137 | A | 7/2006 |
| JP | S57-121810 | A | 7/1982 |
| JP | S59-19030 | A | 1/1984 |
| JP | H06 153200 | A | 5/1994 |
| JP | 2002-035834 | A | 2/2002 |
| JP | 2005-114536 | A | 4/2005 |
| JP | 2008 246496 | A | 10/2008 |
| JP | 2011-140050 | A | 7/2011 |
| JP | 2011140050 | A * | 7/2011 |
| SU | 668 142 | A | 6/1985 |
| WO | 03/059516 | A1 | 7/2003 |

OTHER PUBLICATIONS

Please find the attached translation and original document JP2011140050A from J-PLAT-PAT.*
Original document merged with English abstract of JP 2011140050 A is attached.*
Machine translation of JP 2011140050 A is attached.*
Notification of Reason for Refusal in JP 2014-530097, dated Jun. 9, 2015.
European Office Action in EP 12 778 600.2-1702, dated May 8, 2014, with an English translation of relevant parts.
English translation of Chinese Office Action in CN 201280045071.2, dated Jan. 12, 2015.
Hofmann K. et al: "High-Speed Roll Gap Control in Rod and Bar Mills: A Challenge for Laser Diameter Gages", Aise Steel Technology, Aise, Pittsburg, PA, US., vol. 76, No. 9, Sep. 1, 1999, pp. 42-46, XP000875981.
International Search Report of PCT/DE2012/000909, dated May 7, 2013.
Printout from Wikipedia "Depth of field" Version Sep. 2, 2016 (total of 25 pages) (German Wikipedia "Schärfentiefe" Version Sep. 2, 2016 (total of 12 pages)).
Indian Examination Report with English Translation in Indian Patent Application No. 530/KOLNP/2014 dated Sep. 4, 2018.

* cited by examiner

ROLLING MILL, AND DEVICE AND METHOD FOR DETERMINING THE ROLLING OR GUIDING GAP OF THE ROLL STANDS OR GUIDE STANDS IN A MULTI-STAND ROLLING MILL

CROSS REFERENCE TO RELATED APPLICATIONS

This application is the National Stage of PCT/DE2012/000909 filed on Sep. 14, 2012, which claims priority under 35 U.S.C. § 119 of German Application No. 10 2011 113 135.7 filed on Sep. 14, 2011, the disclosure of which is incorporated by reference. The international application under PCT article 21(2) was not published in English.

The invention relates to a rolling mill and to an apparatus and a method for determination of the rolling gaps or guiding gaps of the roll stands or guide stands in a multi-stand rolling mill.

Multi-stand rolling mills are known, for example, from JP 57-121810 and DE 37 24 982 A1 or SU 668 142 A, in which the rolling gap is supposed to be checked and optimized in accordance with the center line of the rolling mill, in other words the center passage line of the rolling mill, provided in accordance with the mill. For this purpose, stencil bodies are clamped in place between the rolls of a roll stand, in each instance, and aligned by means of a laser system.

It is possible to do without clamping in the case of rolling mills as well as apparatuses and methods for determination of the rolling gaps of the roll stands in a multi-stand rolling mill according to JP 2002-035834 or EP 1 679 137 A1, whereby a comparison scale and a lighting body must be affixed in the vicinity of the roll stand to be measured, in each instance.

It is a disadvantage of these methods of procedure that for this purpose, a component or multiple components must be brought into the vicinity of the roll stand or rolls, in each instance, and this can take place only in relatively complex manner, particularly in the case of roll stands or rolls disposed in the center of the rolling mill, which are accessible only with difficulty.

In contrast, the arrangements and methods of procedure according to JP 59-019030 A, in which a camera is provided at one of the input and output sides of the roll stand, and a light is provided at the other of the input and output sides of the roll stand, or according to DE 37 29 176 A1, in which light and camera are disposed on one of the input or output sides of the roll stand, and a reflector is disposed on the other of the input and output sides of the roll stand, make do without components, whereby here, however, significant imaging inaccuracies must be accepted, particularly due to the significant lengths that such rolling mills have.

It is the task of the present invention to make available rolling mills of the stated type, and apparatuses and methods of the stated type, for determination of the rolling gaps of the roll stands in a multi-stand rolling mill, in which it is possible to perform measurements simply yet precisely.

As a solution, rolling mills and apparatuses and methods for determination of the rolling gaps of the roll stands in a multi-stand rolling mill, having the characteristics of the independent claims, are proposed, whereby particularly preferred embodiments are listed in the dependent claims.

Thus, a rolling mill having an arrangement of roll stands and/or guide stands carrying rolls and/or guides along a center line, disposed in a rolling direction, and having a device for determination of the rolling gaps or guiding gaps of the rolls, which comprises a camera, whereby the rolling mill has an input side and an output side, and the camera is disposed at one of the input or output sides and a background light is disposed at the other of the input or output sides, can be characterized in that the camera has an optical device having a depth of field that reaches over all the roll stands and/or guide stands. In this way, imaging inaccuracies that are caused by a shift in focus and the related movement of the camera optics can be avoided.

Preferably, the required contrast is selected as a sufficient measure of the depth of field of the means for recognition of the contour of a roll surface or guide surface, of the image processing apparatus that follows the camera, which contrast is required by the recognition means in order to be able to recognize a roll surface or guide surface of the rolls or guides of the first and last stand, in sufficiently operationally reliable manner, in each instance. In this way, once the camera has been adjusted, measurement of the rolling gap or guiding gap can be carried out without further adjustment of the optics.

A transmitter for a reference means can be provided at the input side or output side that is disposed opposite the camera. Such a reference means can be, for example, a light beam, for example also a light beam generated by a laser, at which a reference scale is situated, depending on the concrete implementation of the present invention, which scale makes it possible to make dimensional information for each individual stand available for an image processing apparatus that follows the camera, so that the position of the rolls or guides and therefore the rolling gap or guiding gap, in each instance, can be determined correspondingly in accordance with the scale, by way of the image processing. However, in the case of a suitable configuration, it can be sufficient to provide significantly fewer axial positions along the center line, by means of a comparison scale precisely for the image processing using a scale. For example, it can be sufficient if a corresponding comparison scale is measured only in the region of the background lighting or at the first roll stand and/or at the last roll stand, in order to then be able to extrapolate or interpolate the scale for the other stands, by way of triangulation or by way of beam sets, by means of calculation methods sufficiently known in mathematics. The latter has the advantage that only easily accessible regions of the rolling mill must be provided with a comparison scale. The most varied devices can be used as a comparison scale. For example, a separate reference plate is possible; likewise, a corresponding scale can be disposed in the region of the background lighting or also directly on the background lighting, and can accordingly serve as a transmitter for a reference means and as a comparison scale. Likewise, rolls or guides measured elsewhere, precisely or with sufficient accuracy, can serve as reference means or for a determination of the reference scale.

Also, a method for determination of the rolling gaps or guiding gaps of the roll stands and/or guide stands in a multi-stand rolling mill having a center line, whereby a camera is disposed at one of the input or output sides and subsequently the rolling gap or guiding gap of the stands is determined, can be characterized in that before determination of the rolling gap or guiding gap of the stands, the camera is aligned to the center line, using mechanical reference generators, and at least one reference scale is recorded by way of the camera and passed to image processing. Alignment with the center line has the advantage that further adjustment work, which ultimately would impair the measurement result again, is not required.

A comparison scale, markers that can be affixed at the stands ox other frames, such as telescoping holders or bridges with bores, or rolls or guides themselves, for example of the first or last stand, but also a camera holder that has been correspondingly adjusted previously, and is calibrated in sufficiently permanent manner, can be used as mechanical reference generators, for example. Likewise, a transmitter for a reference means, for example a laser beam or another marker in front of background lighting or on background lighting can be used as a reference scale, particularly also if these can be positioned before the measurement, in a suitable holder, which then can be used as a mechanical reference means.

In this connection, it must be taken into consideration that rolling mills are relatively large, and because of the fact that a plurality of stands is disposed very closely one behind the other, the regions between the first and last stand are only accessible with great difficulty, because a plurality of secondary units is also disposed around the rolls and guides. Furthermore, very adverse ambient conditions prevail in the surroundings of rolling mills, so that in general, background lighting and camera, as well as other delicate measurement devices, are removed during rolling, in order for them not to be impaired or to hinder the work.

On the other hand, it is possible that a camera having suitable optics, for example, which allows picture-taking even at very great distances of 30 meters and more, for example, can remain mounted permanently, aligned with the center line, if the work pieces allow this in terms of their length, in each instance.

A correspondingly great distance of the camera from the stands makes it possible, particularly on the basis of the great focal length required then, to make available a correspondingly elongated focal range that has sufficient depth of field over all the stands.

Likewise, background lighting and any reference means can easily be disposed at such a distance, if the other ambient conditions permit this.

A comparison scale, a scale on the background lighting, or even rolls or guides themselves, for example of the first or last stand, can be used as a reference scale, for example. In the case of the latter, the contours of or also the distances between the flanks, for example, which are also not subject to wear, particularly on their side facing away from the work piece, are generally sufficiently known, in terms of their dimensions, so that they can serve as a reference scale.

Then, a scale can be defined by means of the reference scale, for the image processing, on each roll stand, in each instance, which makes it possible to assign an applicable dimension to a roll contour or guide contour that has been recognized.

Thus, the image processing can recognize the contour of a roll or guide surface by way of image recognition, in each instance, for a determination of the rolling gaps or guiding gaps, and can calculate the position of the roll or guide, in each instance, by making reference to the reference scale, which was extrapolated or interpolated from another reference scale, if necessary, by means of mathematical methods.

A rolling mill having an arrangement of roll stands and/or guide stands carrying rolls and/or guides along a center line, disposed in a rolling direction, and having a device for determination of the rolling gaps or guiding gaps of the rolls, which comprises a camera, whereby the rolling mill has an input side and an output side, can be characterized in that a holder for the support of a comparison scale is disposed at the other of the input or output sides. This allows simple positioning of a corresponding comparison scale, which then—depending on the concrete implementation of the present invention—can be used as a reference means, as a reference scale or as a reference generator. If necessary, the support reaches as far as at least through a stand, so that the comparison scale is accordingly used in the interior of the arrangement, on stands. In this manner, it is particularly not necessary to position the comparison scale from the side, between and through the individual stands.

Preferably, the comparison scale can be displaced along the rolling direction, so that measurements can be carried out with the same comparison scale, in each instance, with regard to different roll stands and/or guide stands.

Accordingly, an apparatus for determination of the rolling gaps or guiding gaps of the stands in a multi-stand rolling mill can be characterized by a support vertically attached to a comparison scale.

The support can particularly also be configured as a tube and/or can be attached centered on the comparison scale, thereby facilitating handling, on the one hand, and making it possible to pass on signals to a further reference means, if applicable, centered through the tube. Accordingly, it can be advantageous if the comparison scale has at least one translucent region.

Preferably, the comparison scale has at least two discrete scale positions that clearly define a scale. If necessary, a corresponding edge can also be used in this regard.

Good image recognition can be guaranteed particularly if at least one of the scale positions is configured to be circular and/or translucent. The latter particularly applies in connection with the image recognition already mentioned above.

An apparatus for determination of the rolling gaps or guiding gaps of the roll stands and/or guide stands in a multi-stand rolling mill, having an image processing apparatus that determines the rolling gap or guiding gap, in each instance, from an image of a reference means of a comparison scale taken by the camera and at least one roll or guide, can be characterized in that the position of the reference means in the image is determined and equated with a center line of the rolling mill, and proceeding from this, the position of the roll or guide is determined by way of the comparison scale. By means of this equating, and thereby defining of the center line, it is possible to do without complex calculation mechanisms, which furthermore are also subject to error, in cases of doubt, so that in this way, too, simple and precise measurement can be guaranteed.

Cumulatively or alternatively to the other characteristics of the present invention, a method for determination of the rolling gaps or guiding gaps of the roll stands and/or guide stands in a multi-stand rolling mill, wherein a comparison scale is positioned on each stand, and subsequently the rolling gap or guiding gap of the stand, in each instance, is determined, can be characterized in that before positioning of the comparison scale, a camera is disposed on one of the input or output sides, and a transmitter for reference means, a reference generator and/or a reference scale is disposed at the other of the input or output sides. This accordingly allows targeted and precise positioning of the camera and/or of the comparison scale, if applicable, or rapid calibration of the camera and of the image processing, which can subsequently be utilized for measurements.

Likewise, a method for determination of the rolling gaps or guiding gaps of the roll stands and/or guide stands in a multi-stand rolling mill, wherein a comparison scale is positioned on every stand, and subsequently the rolling gap or guiding gap of the stand, in each instance, is calibrated, can be characterized in that before positioning of the comparison scale on every roll stand, a transmitter for reference means and/or a camera is aligned to a center line of the rolling mill.

The rolling gap or guiding gap, in each instance, can be determined from an image of the reference means, of the comparison scale, of a reference generator and/or of a reference scale taken with the camera, as well as of at least one roll or guide, in that the position of the reference means in the image is determined and equated with the center line, and, proceeding from this, the position of the roll or guide is determined by way of the comparison scale or the reference scale. In this manner, possible positioning or adjustment measures of the camera that would have to take place in the meantime could be avoided, if the process was managed appropriately.

When using a comparison scale, in particular, which is also supposed to be set on in the case of stands disposed between the first and last stand, a method for determination of the rolling gaps or guiding gaps of the roll stands and/or guide stands in a multi-stand rolling mill, wherein a comparison scale is positioned on every stand and subsequently, the rolling gap or guiding gap of the stand, in each instance, is determined, can be characterized in that the comparison scale is positioned on each stand carried from an input side or from an output side of the rolling mill. As a result of this method of procedure, it is not necessary to position a corresponding comparison scale on each roll stand, coming from the side between the stands, which ultimately is comparatively difficult, particularly if the comparison scale is supposed to be between the rolls, if at all possible, coming around the rolls.

Independent of this, a method for determination of the rolling gaps or guiding gaps of the roll stands and/or guide stands in a multi-stand rolling mill, wherein a comparison scale is positioned, and subsequently the rolling gap or guiding gap of the stand, in each instance, is determined, can also be characterized in that the comparison scale has light coming through it. In this manner, image recognition can be carried out in simple and precise manner.

Preferably, at least all the rolls or guides that lie between the camera and the roll or guide to be measured are moved back radially outward or otherwise removed from the viewing field of the camera, in order to take the picture, specifically at least so far that an undistorted image can be recorded. In this manner, the camera can measure the rolls or guides, in each instance, without hindrance and, above all, also without the risk of possible confusion and pass this on to the image processing, whereby the image processing can then also easily recognize a corresponding contour, in operationally reliable manner.

The latter risk can be even further minimized if all the rolls or guides, except for the roll or guide to be measured, are moved back radially outward, or otherwise removed from the viewing field of the camera, in order for the camera to take the picture.

Such removal can be necessary if the rolls or guides cannot be applied individually. Then it can be practical to take entire stands out of the rolling line, in each instance, or to remove individual rolls or guides.

It is understood, in this connection, that if necessary, all the rolls or guides of a stand are applied at the same time, moved into their measurement position and subsequently measured, so that the measurement is performed in a single work step per stand. Possible calculations in the image processing can then be carried out one after the other, if necessary.

The values determined in this manner, with regard to positions of the rolls and guides, can then be utilized for optimization of the gaps. For example, in the case of a three-roll stand, an axial offset can also be compensated within certain limits, in such a manner that a new gap center point or surface focal point of the gap occurs by means of radial adjustment of the rolls, which point lies closer to the center line. Likewise, the measurement values, particularly in interplay with other measurement values, preferably to be determined on-line, can be utilized for regulation of the roll or guide positions during rolling. In this way, too, measurement value generators for the aforementioned measurement values to be determined on-line can be calibrated before the start of rolling.

Accordingly, a method for determination of the rolling gaps or guiding gaps of the roll stands and/or guide stands in a multi-stand rolling mill can be characterized in that roll or guide positions are determined on-line, by way of measurement value generators, and the measurement value generators are previously calibrated in-line. In this way, calibration can take place quickly and precisely, and as a result, the measurement value generators can be optimally used correspondingly, on-line, to control the rolls or guides and their positions.

Preferably, calibration takes place optically, particularly according to the measures found above.

In order to avoid further measurement inaccuracies, the measurement value generators can have a measurement point, such as, for example, a starting point of a path sensor or an illumination point of an optical path sensor, which sensor lies directly on the roll or guide, or is only indirectly connected with the roll or guide by way of mechanical modules.

It is understood that the characteristics of the solutions described above and in the claims can also be combined, if necessary, in order to be able to implement the advantages cumulatively, accordingly.

Figure 2:
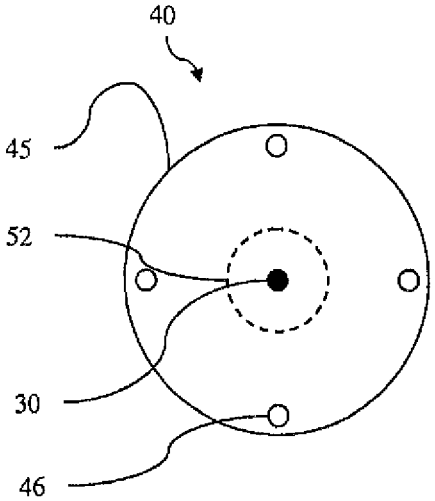
Figure 3:
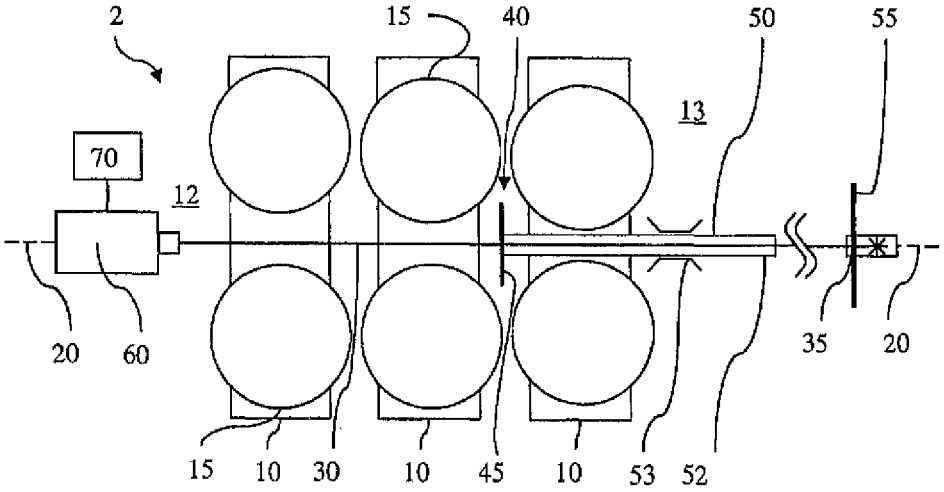
Figure 4:
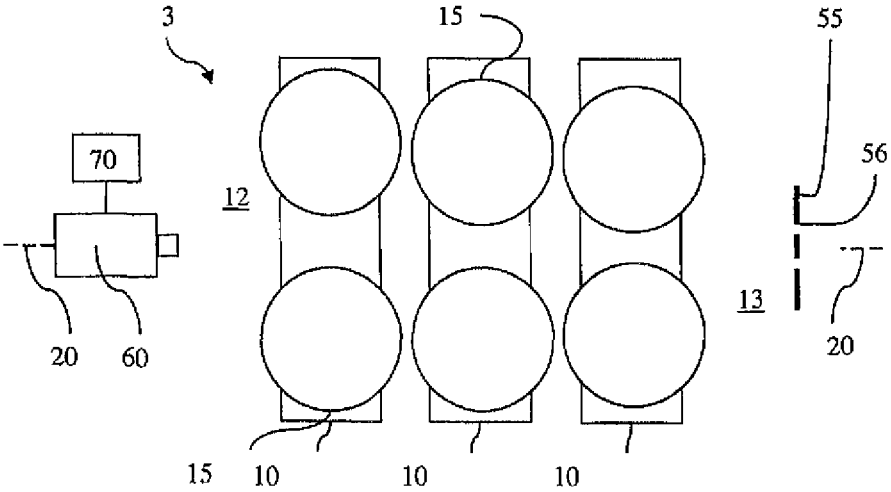

Further advantages, goals, and properties of the present invention will be explained using the following description of exemplary embodiments, which are particularly shown also in the attached drawing. The drawing shows:

FIG. 1 a first rolling mill in a schematic side view;

FIG. 2 a comparison scale in a schematic front view;

FIG. 3 a second rolling mill in a schematic side view;

FIG. 4 a third rolling mill in a schematic side view; and

Figure 5:
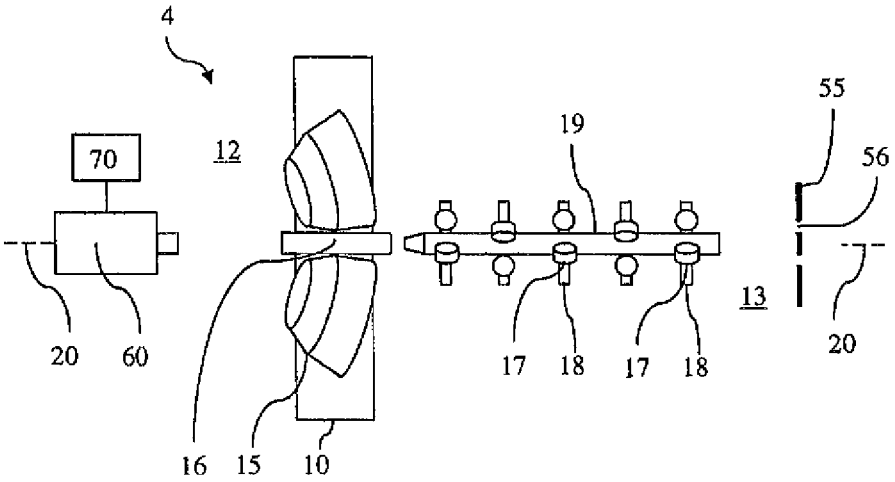

FIG. 5 a fourth rolling mill in a schematic side view.

The rolling mills 1, 2, 3, and 4 shown in FIGS. 1 to 5 comprise roll stands 10, in each instance, which are disposed between an input side 12 and an output side 13, and carry rolls 15, in each instance. In deviation from the rolling mills 1 to 3, which comprise multiple such roll stands 10, in each instance, in the rolling mill 4 only one roll stand and two conical rolls 15, disposed at a slant, and related Diescher disks 16 are disposed on the roll stand 15, whereby furthermore, a plurality of guides 17, which are disposed on guide stands 18, in each instance, and carry a mandrel bar 19, are provided in the rolling mill 4. The guides 17 are successively opened radially with regard to every guide stand 18, when a work piece, driven by way of the mandrel bar 19, reaches the guide stand 18, in each instance. The guides 17 are configured as round disks, whereby it is not absolutely necessary but might be practical if they can also roll, as rolls.

Each of the rolling mills 1 to 4 comprises a center line 20 that ultimately corresponds to the intended pass-through center of a work piece to be rolled, such as, for example, of a pipe, a billet or a rod. To measure the gap, a camera 60 that is connected with an image processing apparatus 70 is placed on the center line 20 with its optical axis or also as defined in some other way, whereby ultimately, it is preferably important that the identical region of the camera 60 detects the center line 20 for each of the stands 10, 18, in each instance, within the scope of measurement accuracy. This has the advantage that no further adjustment measures of the camera 60 or complex and therefore error-prone correction calculations are then required. The latter is furthermore eliminated, in another respect, if the depth of field of the camera 60 is selected in such a manner that it reaches over all the stands 10, 18, because then, adjustments of the optical arrangement of the camera for focusing can also be eliminated. Sufficient depth of field is achieved if the image processing apparatus 70 or a corresponding computer program that runs there can determine a contour of the rolls 15, the guides 17 or also possible scales for each stand 10, 18, using the pictures taken, with sufficient accuracy.

In the present exemplary embodiments, background lighting 55 is preferably provided on the output side, in each instance, in other words on the side opposite the camera 60, which radiates a sufficiently uniform light to the camera 60, so that the contours of the rolls 15 or guides 17 to be measured, in each instance, stand out clearly in front of the background lighting 55. Depending on the concrete embodiment, the background lighting 55 itself can have a scale position, which can take place by means of a hole or by means of a cover, for example, as shown in FIGS. 4 and 5 as an example. Likewise, a separate scale can be provided, which can be utilized as a reference scale. Corresponding scales are explained below, as examples, using FIGS. 1 to 3.

A light plate, preferably with filter films or with LEDs, which might be collimated, and reduce the exit angle from the light plate in order to minimize scattered light, is particularly used as background lighting 55.

In the exemplary embodiments shown in FIGS. 1 to 3, a scale that is configured by means of scale positions 46 in a reference plate, which is utilized as a comparison scale 40, serves as a reference scale. The comparison scale 40 can be displaced on a support 50, which is configured as a support tube 52 in this exemplary embodiment, proceeding from the background lighting 55 in the direction of the camera 60, toward all the roll stands 10 or—if corresponding guides and guide stands, as they are explained using the rolling mill 4 in FIG. 5, are present—toward all the guide stands 18, whereby this is implemented in essentially self-supporting manner, by means of a holder 53 provided in the region of the background lighting 55, whereby a separate holder 53 (see FIG. 3), which is disposed in front of or also behind the background lighting 55, can also be used, depending on the concrete implementation.

A reference dimension can be made available, with relatively great precision, per stand 10, 18, by means of such a comparison scale 40, in each instance, so that the contour of a roll 15 or guide 17 that is determined can also be provided with known dimensions, accordingly. This then allows the image processing to make a statement concerning the precise position of the roll 15 or guide 17, in each instance.

In alternative embodiments, particularly if such a separate comparison scale 40 is eliminated, a corresponding reference dimension can be calculated, for example, from the beam set and one or two scales that are pre-set on the input side or output side, in each instance. Thus, the scale positions 56 of the background lighting 55 can be used as a corresponding reference scale. Likewise, the rolls 15 of the first and last roll stand 10 or the guides 17 of the first and last guide stand 18 can serve as a reference dimension, for example, because these are generally more easily accessible from the outside. It is also understood that a comparison scale can be provided on the input side 12 or the output side 13, in each instance, which scale can be affixed there in some way, in sufficiently defined manner. Ultimately, a long support 50 that can reach through all the stands 10, 18 is not absolutely necessary for this.

In order to facilitate alignment of the camera 60 and/or of the comparison scale 40, or to image the center line 20 in the camera 60 in simple manner, the rolling mills 1 and 2 in FIGS. 1 to 4 have reference means 30, in each instance, having a transmitter 35, which is configured as a laser in this exemplary embodiment. Possibly, LEDs, for example LEDs having different colors, or other kinds of markings, similar to the scale positions 46 and 56 can be used for this purpose. Likewise, rolls 15 or guides 18 that have already been measured with sufficient accuracy elsewhere could be used as reference means 30, for example in that they are suitably applied and then illuminated by the background lighting 55 as a transmitter for the reference means 30, in order to align the camera 60 with regard to the center line 20 in this manner. Likewise, other markers that can be applied to the stands 10 or 18 or other frames, such as, for example, on stand supports or fixed points in the building, can serve this purpose. Such markers can particularly be telescoping rods or bridges with bores or measurement brackets having measurement edges that represent the center line 20.

REFERENCE SYMBOL LIST

1 rolling mill
2 rolling mill
3 rolling mill
4 rolling mill
10 roll stand
12 input side
13 output side
15 roll (numbered as an example)
16 Diescher disk
17 guide (numbered as an example)
18 guide stand (numbered as an example)
19 mandrel bar
20 center line
30 reference means
35 transmitter for reference means
40 comparison scale
45 reference plate
46 scale position (numbered as an example)
50 support
52 support tube
53 holder
55 background lighting
56 scale position (numbered as an example)
60 camera
70 image processing apparatus

The invention claimed is:

1. Rolling mill comprising:

an arrangement of stands comprising at least a first stand and a last stand, the first stand and the last stand selected from a group consisting of roll stands comprising rolls and guide stands comprising guides, said arrangement being arranged along a center line of the rolling mill disposed in a rolling direction, a camera configured to determine rolling gaps of the rolls or guiding gaps of the guides, and a background light that uses a light plate having filter films or LEDs which are collimated and an exit angle from the light plate is reduced which minimizes scattered light from the light plate, and a comparison scale displaced on a support tube positioned between the camera and the light plate of the background light, wherein the rolling mill has an input side and an output side, wherein the camera is fixedly disposed and optically aligned along the center line of the rolling mill at one of the input side and the output side when determining the rolling gaps of the rolls or guiding gaps of the guides, wherein the background light is disposed at the other of the input side and the output side, and wherein the background light is provided on the input side or the output side opposite that of the camera;

wherein the camera has an optical device having a depth of field that reaches over an entirety of the arrangement of stands; and wherein an image processing apparatus that follows the camera is configured to determine a contour of roll surfaces of the rolls or guide surfaces of the guides, and wherein the disposition of the camera having said optical device relative to the rolling mill is such that imaging inaccuracies that are caused by a shift in focus and a related movement of the camera optics is avoided.

2. Rolling mill according to claim 1, comprising a light transmitter for a reference device disposed on the other of the input side or the output side opposite that of the camera.

3. Rolling mill according to claim 1, comprising the comparison scale with scale positions in a reference plate that can be disposed in front of or in each roll stand, proceeding from the background light and/or a transmitter toward the camera on the input side or the output side opposite that of the camera.

4. Rolling mill according to claim 1, wherein a holder for the support tube of the comparison scale is disposed at the other of the input side or the output side.

5. Rolling mill according to claim 4, wherein the support tube reaches from the holder to at least through one stand of the arrangement of stands.

6. Rolling mill according to claim 4, wherein the comparison scale can be displaced along the rolling direction.

7. Rolling mill according to claim 4, wherein the support tube is attached centered on the comparison scale.

8. Rolling mill according to claim 4, comprising the comparison scale having at least one translucent region.

9. Rolling mill according to claim 4, comprising the comparison scale having at least two discrete scale positions.

10. Rolling mill according to claim 9, wherein at least one of the scale positions is configured to be circular.

11. Rolling mill according to claim 9, wherein at least one of the scale positions is configured to be transparent or translucent.

12. Rolling mill according to claim 1, wherein the background light is provided on the output side, and the camera is provided on the input side.

13. Rolling mill according to claim 12, wherein the image processing apparatus is provided on the input side.

14. Rolling mill according to claim 1, comprising the comparison scale which is measured only in the region of the background light or at the first stand of said arrangement of stands and/or at the last stand of said arrangement of stands, in order to then be able to extrapolate or interpolate a scale for the other stands.

15. Rolling mill according to claim 14, wherein said interpolation or extrapolation is done by triangulation of measured points on the rolling components of the guide stands or the rolling stands or reference means in the rolling mill and the relative positions of the acquired measured points along the rolling mill with respect to a reference device or by way of beam sets.

16. Rolling mill according to claim 1, said image processing apparatus determining the rolling gaps of the rolls or guiding gaps of the guides, in each instance, from an image of a reference means taken by the camera, the comparison scale, and at least one roll or guide of the rolling mill, wherein the position of the reference means in the image is determined and equated with the center line of the rolling mill, and proceeding from this, the position of the roll or guide is determined by way of the comparison scale.

17. Rolling mill according to claim 16, wherein said reference means is located on the background light, or said rolls or said guides, for example of the first stand or the last stand of the arrangement of stands, are used as a reference scale.

18. Rolling mill according to claim 1, wherein a reference means is located on the background light, or said rolls or said guides, for example of the first stand or the last stand of the arrangement of stands are used as a reference scale.

19. Rolling mill according to claim 1, wherein roll positions of said rolls or guide positions of said guides are determined on-line, by way of measurement value generators, and the measurement value generators are previously calibrated in-line.

20. Rolling mill according to claim 1, wherein said background light is radiating a sufficiently uniform light to said camera so that contours of the rolls or the guides to be measured, in each instance, stand out clearly in front of the background light without repositioning said background light.

21. Rolling mill according to claim 1, comprising reference means being provided at the first and/or the last roll stand, in the region of the background light, or on the background light.

22. Rolling mill comprising:

an arrangement of stands comprising at least a first stand and a last stand, the first stand and the last stand selected from a group consisting of roll stands comprising rolls and guide stands comprising guides, said arrangement being arranged along a center line of the rolling mill disposed in a rolling direction, a camera configured to determine the rolling gaps of the rolls or guiding gaps of the guides, and a background light that uses a light plate having filter films or LEDs which are collimated and an exit angle from the light plate is reduced which minimizes scattered light from the light plate, wherein the rolling mill has an input side and an output side, wherein the camera is fixedly disposed and optically aligned along the center line of the rolling mill at one of the input side and the output side when determining the rolling gaps of the rolls or guiding gaps of the guides, wherein the background light is disposed at the other of the input side and the output side, and wherein the background light is provided on the input side or the output side opposite that of the camera;

wherein the camera has an optical device having a depth of field that reaches over an entirety of the arrangement of stands; and wherein an image processing apparatus that follows the camera is configured to determine a contour of roll surfaces of the rolls or guide surfaces of the guides, and wherein the disposition of the camera having said optical device relative to the rolling mill is such that imaging inaccuracies that are caused by a shift in focus and a related movement of camera optics can be are avoided;

a comparison scale with scale positions that is disposed in front of or in each roll stand, proceeding from the background light or a transmitter; and a support tube for support of the comparison scale is disposed at the other of the input side or the output side.

23. Rolling mill comprising:

an arrangement of stands comprising at least a first stand and a last stand, the first stand and the last stand selected from a group consisting of roll stands comprising rolls and guide stands comprising guides, said arrangement being arranged along a center line of the rolling mill disposed in a rolling direction, a camera configured to determine the rolling gaps of the rolls or guiding gaps of the guides, and a background light being always outside of the roll stands;

wherein the rolling mill has an input side and an output side, wherein the camera is fixedly disposed at one of the input side and the output side, when determining the rolling gaps of the rolls or guiding gaps of the guides, wherein the background light is disposed at the other of the input side and the output side, and wherein the background light is provided on the input side or the output side opposite that of the camera;

wherein the camera has an optical device having a depth of field that reaches over an entirety of the arrangement of stands; and wherein an image processing apparatus that follows the camera is configured to determine a contour of roll surfaces of the rolls or guide surfaces of the guides, and wherein the disposition of the camera having said optical device relative to the rolling mill is such that imaging inaccuracies that are caused by a shift in focus and a related movement of the camera optics are avoided;

wherein said background light radiates sufficiently uniform light to the camera so that contours of the rolls or the guides to be measured, stand out clearly in front of said background light, a comparison scale with scale positions that is disposed in front of or in each roll stand, proceeding from the background light or a transmitter.

24. Rolling mill comprising:

an arrangement of stands comprising at least a first stand and a last stand, the first stand and the last stand selected from a group consisting of roll stands comprising rolls and guide stands comprising guides, said arrangement being arranged along a center line of the rolling mill disposed in a rolling direction, a camera configured to determine the rolling gaps of the rolls or guiding gaps of the guides, and a background light that uses a light plate having a distance of the light plate to the stands being sufficiently high, and the background light is always outside of the roll stands;

wherein the rolling mill has an input side and an output side, wherein the camera is fixedly disposed at one of the input side and the output side, when determining the rolling gaps of the rolls or guiding gaps of the guides, wherein the background light is disposed at the other of the input side and the output side, and wherein the background light is provided on the input side or output side opposite that of the camera;

wherein the camera has an optical device having a depth of field that reaches over an entirety of the arrangement of stands; and wherein an image processing apparatus that follows the camera is configured to determine a contour of roll surfaces of the rolls or guide surfaces of the guides, and wherein the disposition of the camera having said optical device relative to the rolling mill is such that imaging inaccuracies that are caused by a shift in focus and a related movement of camera optics are avoided;

a comparison scale with scale positions that is disposed in front of or in each roll stand, proceeding from the background light or a transmitter; and a support tube for support of the comparison scale is disposed at the other of the input side or the output side.

* * * * *